United States Patent [19]

Konagai

[11] Patent Number: 4,609,069

[45] Date of Patent: Sep. 2, 1986

[54] SILENCER FOR A PNEUMATICALLY DRIVEN HYDRAULIC JACK

[75] Inventor: Shigetoshi Konagai, Shizuoka, Japan

[73] Assignee: Yasui Sangyo, Ltd., Fujinomiya, Japan

[21] Appl. No.: 688,344

[22] Filed: Jan. 2, 1985

[30] Foreign Application Priority Data

Aug. 14, 1984 [JP] Japan ..... 59-169794

[51] Int. Cl.[4] ..... F01N 1/08

[52] U.S. Cl. ..... 181/230; 181/237; 181/239; 181/272; 173/DIG. 2

[58] Field of Search ..... 181/230, 238, 239, 237, 181/272; 173/DIG. 2

[56] References Cited

U.S. PATENT DOCUMENTS

| | | | |
|---|---|---|---|
| 2,896,580 | 7/1959 | Holdo | 181/230 X |
| 4,093,406 | 6/1978 | Miller | 181/230 X |
| 4,407,390 | 10/1983 | Le Blanc, Jr. | 181/230 |

*Primary Examiner*—Benjamin R. Fuller

*Attorney, Agent, or Firm*—Hayes, Davis & Soloway

[57] ABSTRACT

A silencer for a pneumatically operated hydraulic jack equipped with an air motor is provided. The silencer comprises a first low-pressure chamber formed contiguously to the rear wall of the main cylinder of the air motor, a second low-pressure chamber formed contiguously to and behind the first low-pressure chamber, a baffleplate partitioning the first and second low-pressure chambers and having two groups of first holes formed at an angular displacement of 90 degrees from a pair of discharge holes formed diametrically opposite to each other and radially so as to discharge high-pressure air from the main cylinder of the air motor into the first low-pressure-chamber, and two groups of second holes formed at an angular displacement of 90 degrees from the two groups of the first holes respectively in the rear wall of the second low-pressure chamber to discharge air into the atmosphere. A valve disposed in the rear wall of the main cylinder is opened and closed automatically according to the reciprocation of the main piston of the air motor so that the compressed air supplied into the high-pressure side of the main cylinder is discharged for the return travel of the main piston. The high-pressure air discharged from the main cylinder of the air motor is branched into opposite flows and those opposite flows collide and dissipate their energy as they flow through the first and second holes so that exhaust noise of the air motor is suppressed.

3 Claims, 7 Drawing Figures

SILENCER FOR A PNEUMATICALLY DRIVEN HYDRAULIC JACK

BACKGROUND OF THE INVENTION

1. Filed of Industrial Application:

The present invention relates to a silencer for a pneumatically driven hydraulic jack and more particularly to a silencer for suppressing the exhaust noise of an air motor for driving a hydraulic jack.

2. Description of the Prior Art:

In a conventional pneumatically driven hydraulic jack, compressed air of a high pressure, for example, 6 to 10 kg/cm$^2$, is discharged from the air motor through the discharge port during the return travel of the piston of the air motor. Accordingly, in the normal operating state, the air motor generates an exhaust noise of 90 dB or greater as measured 1 m away from the air motor, which is a noise exceeding an allowable limit.

A device for suppressing such an exhaust noise is disclosed, for example, in U.S. Pat. No. 4,093,406. This device is constituted so as to discharge air indirectly into the atmosphere through a plurality of baffleplates to suppress the exhaust noise. This device, however, has disadvantages that the construction is complex and expensive and the resistance of the baffleplates to the air passing therethrough affects adversely to the efficiency of the associated apparatus.

SUMMARY OF THE INVENTION

The present invention provides a silencer for a pneumatically driven hydraulic jack to eliminate the foregoing disadvantages of the prior art. A silencer according to the present invention, for a pneumatically driven hydraulic jack equipped with a hydraulic pump having a plunger adapted to be reciprocated by an air motor of which the main piston is reciprocated by the repetition of a working cycle of moving the main piston for a working travel beyond a limiting port formed at an appropriate position in the main cylinder by supplying compressed air into the main cylinder from behind the main piston, opening a valve provided on the rear wall of the main cylinder by part of the high-pressure air supplied into the main cylinder and escaping through the limiting port to exhaust the main cylinder, and moving the main piston for a return travel with a spring provided within the main cylinder as far as the valve is closed, comprises a first low-pressure chamber formed contiguously to the rear wall of the main cylinder, a second low-pressure chamber formed contiguously to and behind the first low-pressure chamber, a baffleplate partitioning the first and second low-pressure chambers, a pair of discharge holes formed diametrically opposite to each other and radially in the first low-pressure chamber to discharge the high-pressure air from the main cylinder, two groups of first holes formed at an angular displacement of 90 degrees from the discharge holes respectively in the baffleplate, and two groups of second holes formed at an angular displacement of 90 degrees from the groups of the first holes in the rear wall of the second low-pressure chamber.

In the silencer according to the present invention, since the two groups of the first holes are formed at an angular displacement of 90 degrees from the discharge holes respectively, the high-pressure air discharged from the main cylinder is jetted out radially through the discharge holes into the first low-pressure chamber in two opposite flows, which collide before the first holes to dissipate energy and flow into the second low-pressure chamber through the first holes. Similar energy dissipation occurs before the second holes in the second low-pressure chamber. Thus the high-pressure air is discharged into the atmosphere after the energy thereof has been dissipated at two energy dissipating stages.

Thus the silencer according to the present invention suppresses the exhaust noise of the air motor by dissipating the energy of the high-pressure air discharged at every reciprocation of the main piston.

Accordingly, it is an object of the present invention to provide a silencer for a pneumatically driven hydraulic jack, capable of suppressing the exhaust noise of the air motor by means of a simple and inexpensive mechanism without affecting adversely to the efficiency of the air motor.

Other objects, features and advantages of the present invention will become apparent from the description of a preferred embodiment thereof taken in connection with the accompanying drawings.

DESCRIPTION OF THE PREFERRED EMBODIMENT

Figure 1:
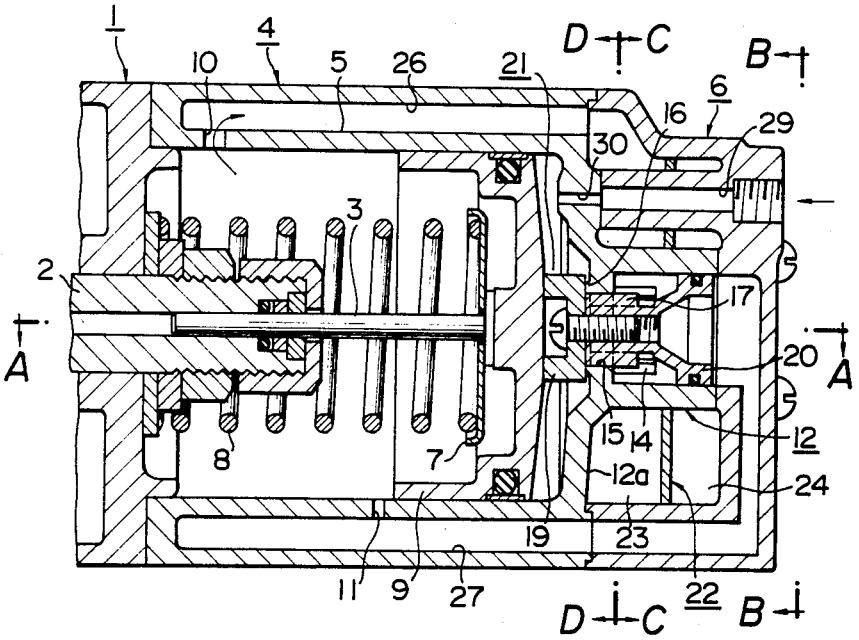
FIG. 1 is a longitudinal section of an air motor for a hydraulic jack, equipped with a silencer of the present invention, in which the main piston is staying at the rear dead position.
Figure 2:
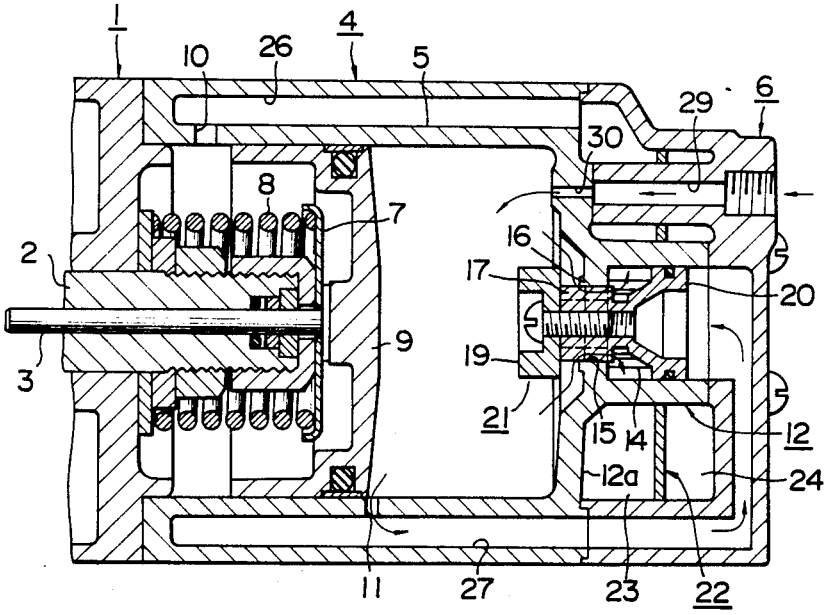
FIG. 2. is a longitudinal section similar to FIG. 1, in which the main piston is staying at the front dead position.
Figure 3:
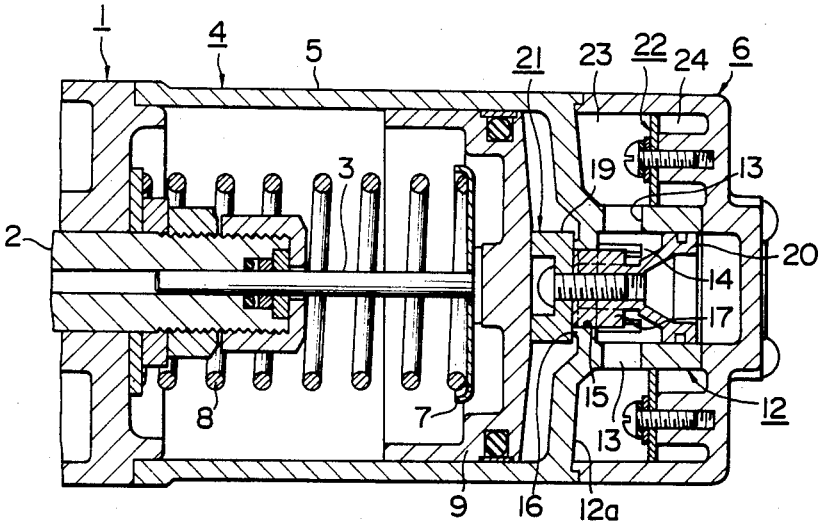
FIG. 3 is a sectional view taken along line A—A of FIG. 1.
Figure 4:
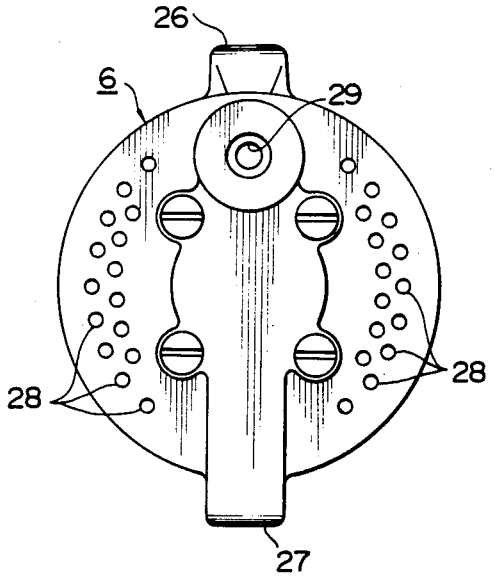
FIG. 4 is an end view on arrows B of FIG. 1.
Figure 5:
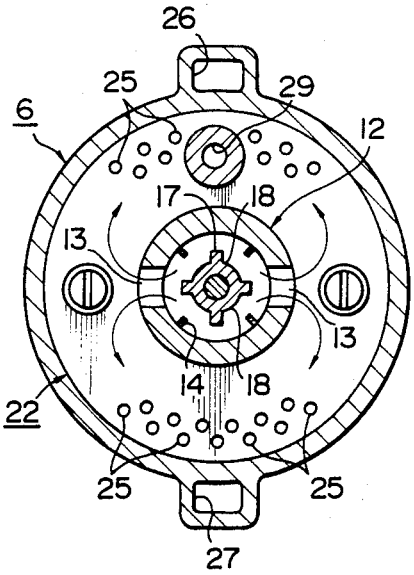
FIG. 5 is a cross section taken along line C—C of FIG. 1 and viewed on arrows C.

In FIGS. 1 to 3, indicating at 1 is the hydraulic cylinder of a hydraulic jack, at 2 is the hydraulic pump of the hydraulic jack and at 3 is the plunger of the hydraulic pump. The hydraulic jack lifts up an automobile or the like as the plunger is reciprocated to supply working fluid to the power cylinder and lowers the same as the hydraulic fluid is released from the power cyliner by operating a valve.

The main cylinder 5 of an air motor 4 for driving the pump 2 is attached to the rear end, i.e., the right-hand end as viewed in FIG. 1 (in FIGS. 1 to 3, the right side and the left side in the drawing will be called as the rear side and the front side respectively) of the hydraulic cylinder 1 and a cover 6 of a form of a bottomed cylinder is attached to the rear end of the main cylinder 1.

The plunger 3 is urged rearward by a compressing spring 8 inserted between the rear end wall of the hydraulic cylinder 1 and a disk 7 attached to the rear end of the plunger 3. The rear end of the plunger 3 is always in abutment with the front surface of a main piston 9 fitted in the main cylinder 5.

An outlet port 10 is formed at the front end of the circumference of the main cylinder 5 and a limiting port 11 is formed at a suitable position in the central section of the main cylinder 5.

A secondary cylinder 12 is formed integrally and coaxially with the main cylinder 5 on the rear end wall of the main cylinder 5 so as to protrude into the cover 6. A pair of discharge holes 13 are formed radially opposite to each other in the front portion of the secondary cylinder 12.

Axially extending stoppers 14 are protruded from the inside surface of the secondary cylinder 12. A valve hole 15 is formed through and in the central portion of the bottom wall 12*a* of the secondary cylinder 12. An annular valve seat 16 of a diameter smaller than the inside diameter of the secondary cylinder 12 is formed around the valve hole 15 in the front surface of the bottom wall 12*a*. A valve stem 17 having a plurality of axially extending discharging grooves 18 in the outer surface is slidably fitted in the valve hole 15. A valve element 19 of a form of a bottomed cylinder opening in the front and adapted to be seated in the valve seat 16 is fixed to the front end of the valve stem 17. A secondary piston 20 fitted in the secondary cylinder 12 is fixed to the rear end of the valve stem 17. The forward travel of the secondary piston 20 is restricted by the stoppers 14 so that the discharge holes 13 will not be closed by the secondary piston 20. The valve hole 15, the valve seat 16, the valve stem 17, the discharging grooves 18 and the valve element 19 constitute a valve 21.

The interior space of the cover 6 is partitioned by a baffleplate 22 receiving the secondary cylinder 12 therethrough into a first low-pressure chamber 23 in the front portion of the interior space and a second low-pressure chamber 24 in the rear portion of the interior space. A plurality of first holes 25 are formed in an upper portion and in a lower portion of the baffleplate 22.

The outlet port 10 and the limiting port 11 communicates with the second low-pressure chamber 24 and with the rear opening of the secondary cylinder 12 by means of a discharge passage 26 and a connecting passage 27 respectively.

A plurality of second holes 28 are formed in the right side and the left side of the rear wall of the cover 6. A compressed air supplying passage 29 penetrating through the baffleplate 22 and communicating with the high-pressure side of the main cylinder 5 is formed in an upper part of the cover 6. The front end portion of the compressed air supplying passage formed through the rear wall of the main cylinder 5 is reduced to form an inlet port 30.

In FIG. 1, the main piston 9 has been moved to the rear dead position by the compression spring 8 and the valve 21 is closed. As compressed air is supplied into the main cylinder 5, the main piston 9 moves forward for the working travel compressing the compression spring 8 from the rear dead position, while the valve 21 is kept closed by the compressed air supplied into the main cylinder 5.

As shown in FIG. 2, after the main piston 9 has moved forward beyond the limiting port 11, the high-pressure side of the main cylinder 5 communicates with the connecting passage 27 by means of the limiting hole 11. Consequently, the same pressure is applied to the rear surface of the secondary piston 20 fitted in the secondary cylinder 12 and to the front surface of the valve element 19 of the valve 21. However, since the secondary piston 20 has a diameter greater than that of the valve seat 16, the secondary piston 20 advances together with the valve element 19 as far as it is stopped by the stoppers 14, and thereby the valve 21 is opened. Then, the high-pressure air prevailing within the main cylinder 5 flows rapidly through the discharging grooves 18 of the valve stem 17 into the low-pressure side of the secondary cylinder 12, i.e., the space before the secondary piston 20, and then into the first low-pressure chamber 23 through the discharge holes 13.

Figure 6:
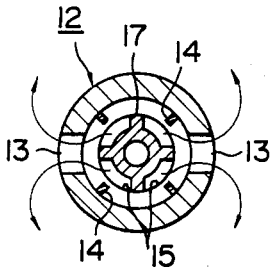
FIG. 6 is a cross section taken along line D—D of FIG. 1 and viewed on arrows D, showing the essential portion of the silencer.
Figure 7:
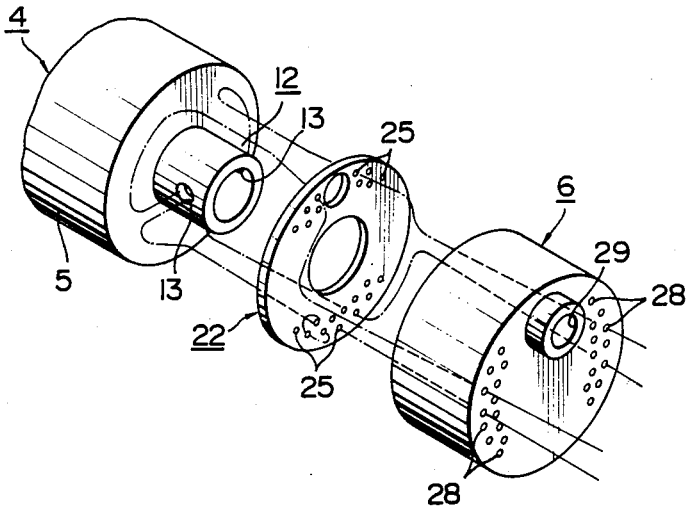
FIG. 7 is an exploded perspective view of the essential parts of the silencer embodying the present invention, showing the flow passage of high-pressure air through the silencer.

Since the first holes 25 are formed in two groups in an upper portion and a lower portion of the baffleplate 22, the high-pressure air discharged through the discharge holes 13 is branched into upward flows and downward flows in the first low-pressure chamber 23 as indicated by arrows in FIG. 6. These flows of highpressure air collide before the first holes 25 dissipating the energy and flow through the first holes 25 into the second low-pressure chamber 24. In the second low-pressure chamber 24, the flows of somewhat dissipated high-pressure air collide likewise and dissipate the energy further before the second holes 28. The high-pressure exhaust air is discharged into the atmosphere after thus dissipating the energy.

The valve 21 of the silencer of the present invention is opened and closed at every reciprocation of the main piston 9 of the air motor 4 to discharge the high-pressure air through the silencer after making the exhaust air dissipate its energy through the abovementioned process.

Since the inlet port 30 formed at the front end of the compressed air supplying passage 29 has a small diameter, the flow rate of the compressed air that flows through the inlet port 30 into the main cylinder 5 is lower by far than the discharging rate, and hence the pressure in the high-pressure side of the main cylinder 5 drops sharply while the valve 21 is opened to discharge the high-pressure air from the main cylinder 5. Consequently, the main piston 9 is moved rearward for the return travel by the compression spring 8 and presses the valve element 16 of the valve 21 against the valve seat 16 to close the valve 21. Then, the main piston 9 is moved forward again for the working travel by the compressed air supplied through the inlet port 30. Thus the main piston 9 of the air motor 4 is reciprocated automatically between the limiting port 11 and the valve element 19 by the compressed air to drive the hydraulic pump 2.

As apparent from what has been described hereinbefore, the silencer according to the present invention is capable of satisfactorily suppressing the noise generated by the air motor of a pneumatically driven hydraulic jack, of being manufactured at a reduced cost owing to its simple construction and of reducing the efficiency of the air motor only slightly owing its small resistance to the discharging air flow.

What is claimed is:

1. A silencer, for a pneumatically driven hydraulic jack equipped with a hydraulic pump having a plunger adapted to be reciprocated by an air motor of which a main piston, contained within a main cylinder of the air motor is reciprocated by the repetition of a working cycle of moving the main piston for a working travel beyond a limiting port formed at a appropriate position in the main cylinder by supplying compressed air into the main cylinder from behind the main piston, opening a valve provided on a rear wall of the main cylinder by part of the compressed air supplied into the main cylinder and escaping through the limiting port to exhaust the main cylinder, and moving the main piston for a return travel with a spring provided within the main cylinder as far as the valve is close, comprising a first low-pressure chamber formed contiguously to the rear wall of the main cylinder, a second low-pressure chamber formed contiguously to and behind the first low-pressure chamber, a baffleplate partitioning the first and second low-pressure chambers, a secondary cylinder, located behind the main cylinder, having a pair of discharge holes formed diametrically opposite to each other and radially extending to the first low-pressure chamber to discharge the high-pressure air from the main cylinder, two groups of first holes formed at an angular displacement of 90 degrees from the discharge holes respectively in the baffleplate, and two groups of second holes formed at an angular displacement of 90 degrees from the groups of the first holes in the rear wall of the second low-pressure chamber.

2. A silencer according to claim 1, wherein said valve consists of a valve stem fitted in a through hole formed in the rear wall of the main cylinder, a valve element fixed to the front end of the valve stem in the main cylinder, a valve seat formed around the through hole and a secondary piston fixed to the rear end of the valve stem and fitted in a secondary cylinder formed integrally with and behind the rear wall of the main cylinder.

3. A silencer according to claim 2, wherein the diameter of the valve seat is smaller than the outside diameter of the second piston.

* * * * *